US006494550B1

(12) United States Patent
Chen et al.

(10) Patent No.: US 6,494,550 B1
(45) Date of Patent: Dec. 17, 2002

(54) FIXING BASE STRUCTURE OF A SLIDE TRACK

(75) Inventors: Ken-Ching Chen, Kaohsiung Hsien (TW); Shu-Jiuan Lin, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/867,451

(22) Filed: May 31, 2001

(51) Int. Cl.[7] ..... A47B 88/00
(52) U.S. Cl. ..... 312/334.5; 312/334.7
(58) Field of Search ..... 312/334.5, 334.4, 312/334.12, 334.7, 334.21, 334.42, 334.1, 330.1, 334.27; 384/22; 248/231.9, 225.11, 220.21, 220.31, 220.41, 220.42, 220.43; 16/94 R

(56) References Cited

U.S. PATENT DOCUMENTS 5,257,861 A 11/1993 Domenig et al.
5,306,080 A * 4/1994 Lautenschlager et al. ..... 312/334.5
5,387,033 A * 2/1995 Domenig ..... 248/201
5,636,820 A * 6/1997 Domenig ..... 248/200
5,823,648 A * 10/1998 Domenig ..... 312/334.5

FOREIGN PATENT DOCUMENTS

DE 4124535 * 1/1993 ..... 312/334.5

* cited by examiner

*Primary Examiner*—Janet M. Wilkens
(74) *Attorney, Agent, or Firm*—Bacon & Thomas, PLLC

(57) ABSTRACT

A fixing base structure of a slide track. The fixing base includes snap members, a guide channel, a retaining groove, and a retaining plate. The snap members are arranged on the back face of the fixing base. The guide channel is provided in the front face of a fixing base, and the retaining groove is matingly provided in the guide channel. In the structure of the guide channel, the guide channel is matingly provided with a retaining plate located above the retaining groove. When the slide track is mounted in the guide channel of the fixing base, the retaining plate elastically presses the slide track in the retaining groove, such that the slide track and the fixing base may have a better combination positioning effect therebetween.

8 Claims, 3 Drawing Sheets

FIXING BASE STRUCTURE OF A SLIDE TRACK

BACKGROUND OF THE INVENTION

1. Field of the Invention

The present invention relates to a fixing base structure of a slide track, and more particularly to a fixing base structure including a fixing base having a retaining plate elastically pressing a slide track in a retaining groove of the fixing base, such that relative wobbling or detachment will not happen between the slide track and the fixing base.

2. Description of the Related Art

The closest prior art of which the applicant is aware is disclosed in U.S. Pat. No. 5,257,861 to Domenig et al., issued on Nov. 22, 1993, which is shown in FIG. 1. The U.S. Pat. No. 5,257,861 disclosed a fixing base and a slide track. The fixing base 10 has a first end provided with a stop 10*a,* and a second end provided with a pair of spring flanges 10*b.* the slide track 20 is provided with a through slot 20*a.* When the fixing base 10 is combined with the slide track 20, the stop 10*a* is matingly snapped in the through slot 20*a,* thereby properly limiting the relative displacement between the fixing base 10 and the slide track 20, so that the slide track 20 is displaced on the fixing base 10 along the through slot 20*a.* At this time, although the pair of spring flanges 10*b* at one end of the fixing base 10 may elastically fix the slide track 20, the stop 10*a* at the other end of the fixing base 10 is connected with the through slot 20*a* in a simple snap manner, so that wobbling easily produces between the stop 10*a* and the through slot 20*a,* and the parts easily hit each other. Thus, the wobbling incurring between the stop 10*a* and the through slot 20*a* easily causes the stop 10*a* to wear or detach.

SUMMARY OF THE INVENTION

With regard to this, for overcoming the above-described drawbacks, the retaining groove of the fixing base is matingly provided with the retaining plate, thereby elastically pressing the slide track on the fixing base. In addition, the retaining groove and the retaining plate are matingly mounted on the guide channel, so that wobbling will not happen when the slide track is combined in the guide channel of the fixing base, thereby enhancing the usage reliability of the product.

The primary objective of the present invention is to provide a fixing base structure of a slide track, wherein a fixing base is provided with a retaining groove, and a retaining plate for fixing combination of a positioning plate of a slide track, so that fixing base structure of the present invention can enhance the combination effect of the parts.

A secondary objective of the present invention is to provide a fixing base structure of a slide track, wherein the guide channel of the fixing base is matingly provided with the retaining groove and the retaining plate. Thus, after the slide track is combined in the guide channel of the fixing base, the slide track is retained by the retaining groove and pressed by the retaining plate, so that relative wobbling or vibration will not happen between the slide track and the fixing base, such that the present invention can enhance the usage reliability of the product.

In accordance with the present invention, there is provided a fixing base structure of a slide track, wherein the fixing base includes a plurality of snap members, a guide channel, a retaining groove, and a retaining plate. The snap members are arranged on the back face of the fixing base. The guide channel is provided in the front face of a fixing base, and the guide channel is matingly provided with the retaining groove and the retaining plate. When the slide track is mounted in the guide channel of the fixing base, the retaining plate elastically presses the slide track in the retaining groove, so that wobbling will not produce after the slide track is combined in the guide channel of the fixing base. When the positioning plate of the slide track is adjusted to displace in the retaining groove of the fixing base, the retaining plate of the fixing base still elastically presses the positioning plate of the slide track in the retaining groove, so that the slide track is stably displaced in the guide channel of the fixing base.

Further benefits and advantages of the present invention will become apparent after a careful reading of the detailed description with appropriate reference to the accompanying drawings.

DETAILED DESCRIPTION OF THE PREFERRED EMBODIMENTS

Figure 2:
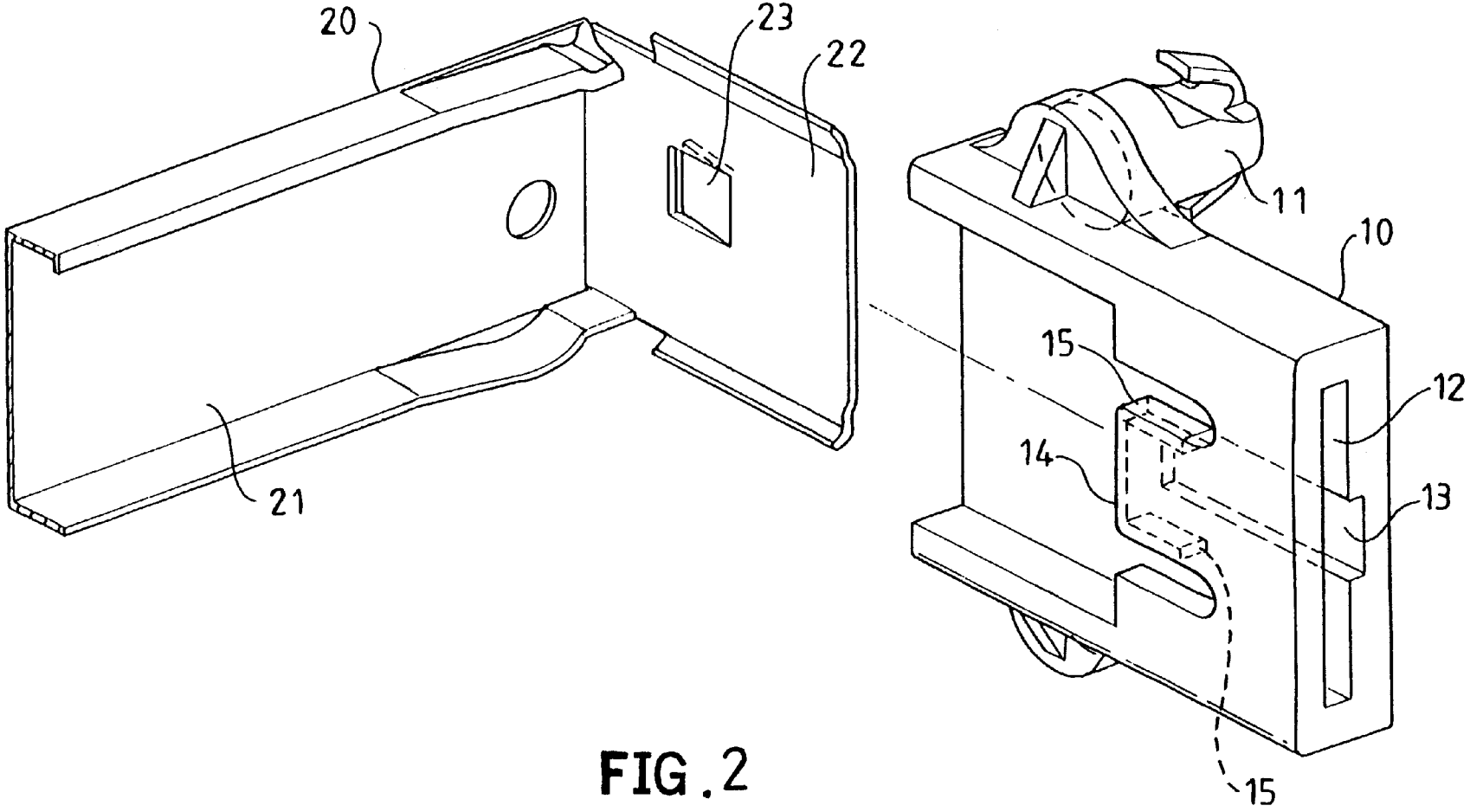
FIG. 2 is an exploded perspective view of a fixing base structure of a slide track in accordance with the preferred embodiment of the present invention.

Referring to the drawings and initially to FIG. 2, a fixing base structure of a slide track used in the furniture in accordance with the preferred embodiment of the present invention comprises a fixing base 10 made of hard solid material, such as plastic, metal or the like. The fixing base 10 of the fixing base structure presents a thin and flat body, and is formed with a front face and a back face. The fixing base 10 includes a plurality of snap members 11, a guide channel 12, a retaining groove 13, and a retaining plate 14 which are preferably formed integrally with each other. The snap members 11 are arranged on the back face of the fixing base 10 to be inserted into the fixing holes (not shown) of the furniture, for fixing the back face of the fixing base 10 on the furniture. The front face of the fixing base 10 is provided with the guide channel 12, the retaining groove 13, and the retaining plate 14. The guide channel 12 is preferably mounted on the front face of the fixing base 10, and is formed with a thin and flat passage for passage of the slide track 20. The structure of the guide channel 12 is matingly provided with the retaining groove 13, and the retaining plate 14. The retaining groove 13 is formed in the guide channel 12, and is extended along the longitudinal direction of the guide channel 12. The retaining plate 14 is matingly mounted above the retaining groove 13. The retaining plate 14 is protruded with a plurality of lugs 15 directed toward the retaining groove 13. In addition, one end of the retaining plate 14 is connected to the fixing base 10, and the retaining plate 14 has proper elastic deformation along the longitudinal direction of the guide channel 12. A slide track 20 is fitted and assembled on the fixing base 10. The slide track 10 is made of hard solid material, such as metal or the like. The structure of the slide track 20 presents an elongated strip body, and the slide track 20 includes a body 21 which allows displacement of pulleys that support the drawer (not shown) of the furniture. One end of the body 21 is bent to form a bent portion 22 which is combined in the guide channel 12 of the fixing base 10. A proper position of the bent portion 22 is provided with a positioning plate 23 by the punching process. The positioning plate 22 has a proper shape that may be matingly fitted in the retaining groove 13 of the fixing base 10.

Figure 3:
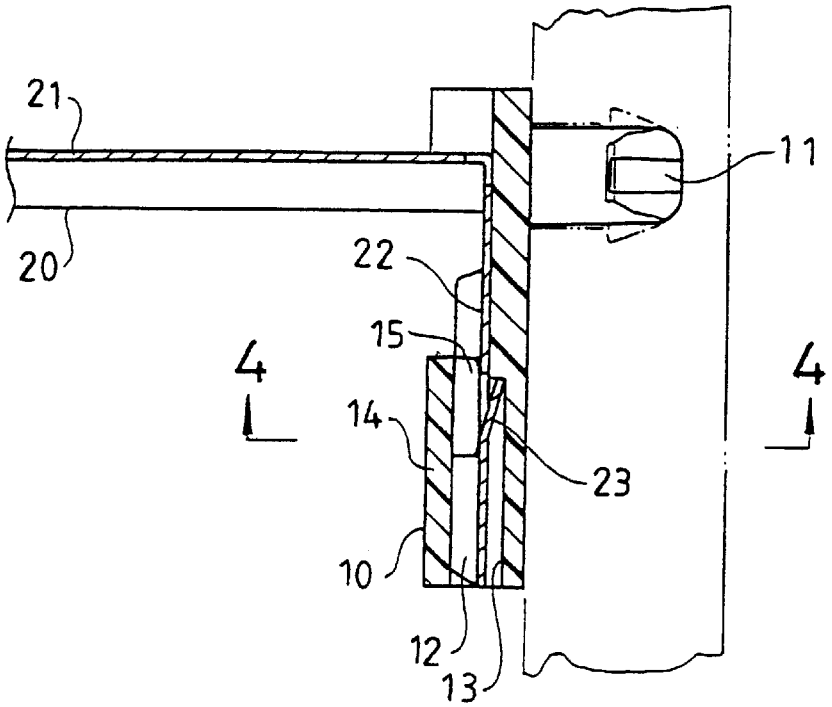
FIG. 3 is a front cross-sectional assembly view of the fixing base structure of a slide track as shown in FIG. 2.

Referring to FIGS. 2 and 3, when the bent portion 22 of the slide track 20 is fitted in the guide channel 12 of the fixing base 10, the width of the bent portion 22 is properly mated with that of the guide channel 12, so that a large wobbling or vibration will not be created between the slide track 20 and the fixing base 10 along the horizontal direction of the guide channel 12. The retaining plate 14 of the fixing base 10 elastically presses the bent portion 22, thereby retaining the positioning plate 23 in the retaining groove 13, such that the wobbling or vibration will not be created between the slide track 20 and the fixing base 10 along the vertical direction of the guide channel 12 of the fixing base 10. When the positioning plate 23 of the slide track 20 is adjusted to displace in the retaining groove 13 of the fixing base 10, the retaining plate 14 of the fixing base 10 still elastically presses the positioning plate 23 of the slide track 20 in the retaining groove 13, so that the slide track 20 is stably displaced in the guide channel 12 of the fixing base 10.

Figure 4:
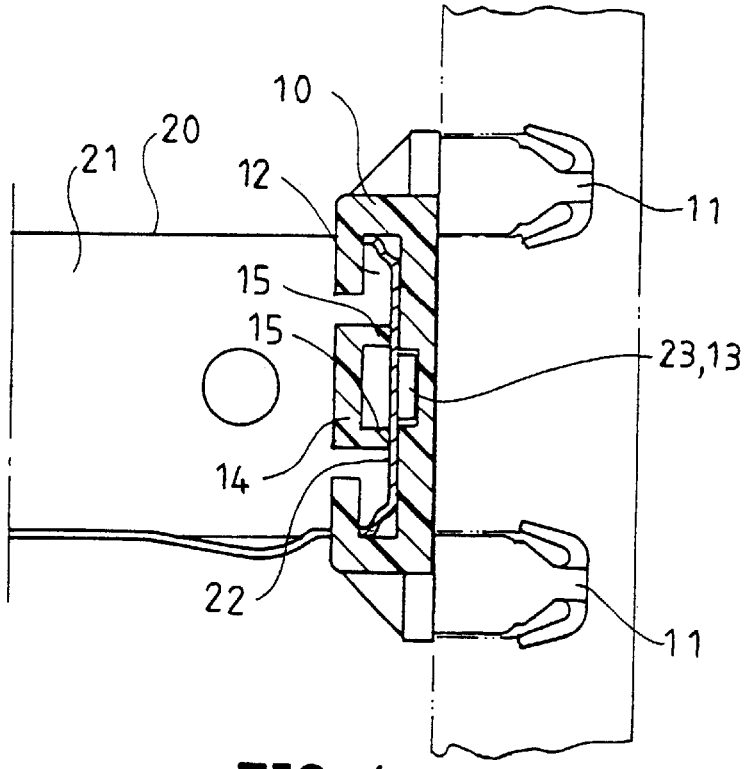
FIG. 4 is a cross-sectional view of the fixing base structure of a slide track along line 4—4 as shown in FIG. 3.

Referring to FIGS. 3 and 4, the fixing base 10 of the slide track used in the furniture in accordance with the preferred embodiment of the present invention may use a plurality of lugs 15 to elastically rest and press the surface of the bent portion 22 of the slide track 20, thereby tightly combining the slide track 20 with the fixing base 10, so that the slide track 20 cannot easily wobble or vibrate in the guide groove 13.

Figure 1:
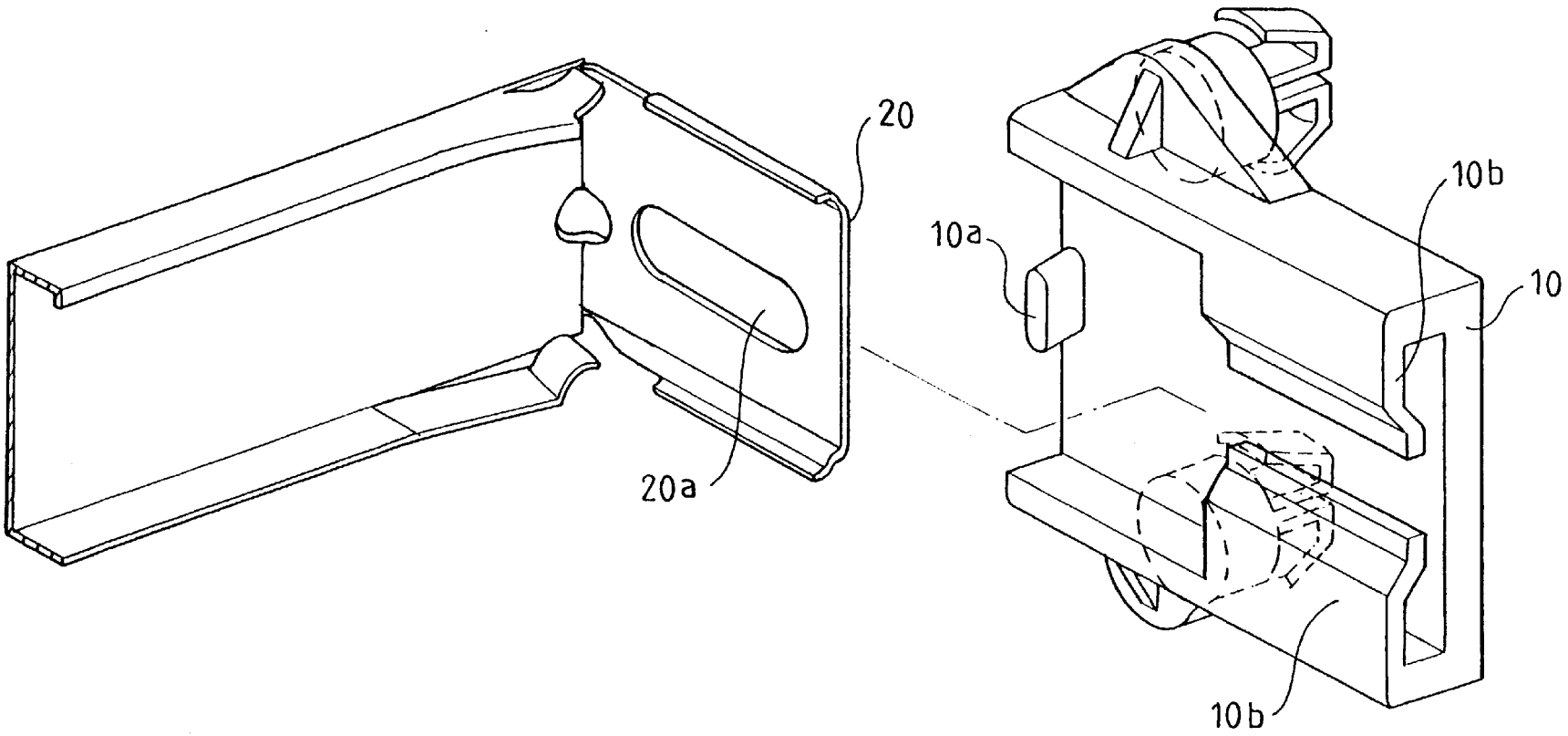
FIG. 1 PRIOR ART
FIG. 1 is an exploded perspective view of a conventional fixing base structure of a slide track in accordance with the prior art.

Referring to FIG. 1, the fixing base structure of the slide track used in the furniture of U.S. Pat. No. 5,257,861 may be compared with the fixing base structure of the slide track used in the furniture in accordance with the present invention. The stop 10*a* of the conventional fixing base 10 and the through slot 20*a* of the slide track 20 are connected by a simple snap manner only, so that wobbling or vibration easily produces between the stop 10*a* and the through slot 20*a,* and the parts easily hit with each other. Thus, in the U.S. Pat. No. 5,257,861, it is necessary to further improve the snap manner between the fixing base 10 and the slide track 20. In comparison, the fixing base 10 of the present invention is provided with a retaining groove 13 and a retaining plate 14, for fixing and combining the positioning plate 23 of the slide track 20, so that the present invention can enhance the combination effect of the parts. In addition, the guide channel 12 of the fixing base 10 of the present invention is matingly provided with a retaining groove 13 and a retaining plate 14, so that after the slide track 20 is combined in the guide channel 12 of the fixing base 10, relative wobbling or vibration will not happen between the slide track 20 and the fixing base 10, so that the present invention can enhance the usage reliability of the product.

Although the invention has been explained in relation to its preferred to embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A fixing base structure of a slide track, comprising:

a guide channel provided in a front face of a fixing base for passage and mounting of a slide track;

a retaining groove matingly provided in said guide channel, for mounting of a positioning plate of said slide track; and a retaining plate matingly provided in said guide channel and structurally aligned with said retaining groove; and wherein when said slide track is mounted in said guide channel of said fixing base, said retaining plate elastically presses said slide track so that said positioning plate is elastically deformed into said retaining groove so that said positioning plate is retained in said retaining groove, such that relative wobbling will not be produced between said slide track and said fixing base.

2. The fixing base structure of a slide track as claimed in claim 1, wherein said fixing base has a back face provided with a plurality of snap members that can be inserted into fixing holes of a piece of furniture, for fixing said back face of said fixing base on said furniture.

3. The fixing base structure of a slide track as claimed in claim 1, wherein said guide channel, said retaining groove and said retaining plate are integrally formed with each other.

4. The fixing base structure of a slide track as claimed in claim 1, wherein said retaining groove is formed in said guide channel, and is extended along a longitudinal direction of said guide channel.

5. The fixing base structure of a slide track as claimed in claim 1, wherein said retaining plate is protruded with a plurality of lugs directed toward said retaining groove and rested and pressed on a surface of said slide track, thereby tightly combining said slide track on said fixing base.

6. The fixing base structure of a slide track as claimed in claim 5, wherein said retaining plate has one end on said retaining groove connected to said fixing base, and said retaining plate has proper elastic deformation along a longitudinal direction of said guide channel, said lugs are used to elastically press the surface of said slide track, thereby tightly combining said slide track on said fixing base.

7. The fixing base structure of a slide track as claimed in claim 1, wherein said retaining plate is integrally formed with a top plate of a front face of said fixing base as a singular member, in order to reduce overall thickness.

8. The fixing base structure of a slide track as claimed in claim 1, wherein said retaining plate is extended substantially parallel to said retaining groove, so as to facilitate said retaining plate to be elastically bent on said retaining groove for assembling the slide track.

* * * * *